US011482106B2

(12) United States Patent
Kanade

(10) Patent No.: US 11,482,106 B2
(45) Date of Patent: Oct. 25, 2022

(54) ADAPTIVE TRAFFIC SIGNAL WITH ADAPTIVE COUNTDOWN TIMERS

(71) Applicant: Udayan Kanade, Pune (IN)

(72) Inventor: Udayan Kanade, Pune (IN)

( * ) Notice: Subject to any disclaimer, the term of this patent is extended or adjusted under 35 U.S.C. 154(b) by 0 days.

(21) Appl. No.: 17/273,075

(22) PCT Filed: Sep. 4, 2019

(86) PCT No.: PCT/IB2019/057461
§ 371 (c)(1),
(2) Date: Mar. 3, 2021

(87) PCT Pub. No.: WO2020/049488
PCT Pub. Date: Mar. 12, 2020

(65) Prior Publication Data

US 2021/0327267 A1 Oct. 21, 2021

(30) Foreign Application Priority Data

Sep. 4, 2018 (IN) ..... 201821033148

(51) Int. Cl.

| | |
|---|---|
| ***G08G 1/083*** | (2006.01) |
| ***G08G 1/096*** | (2006.01) |
| ***G08G 1/01*** | (2006.01) |
| ***G08G 1/082*** | (2006.01) |
| ***G08G 1/095*** | (2006.01) |

(52) U.S. Cl.
CPC ..... *G08G 1/096* (2013.01); *G08G 1/0145* (2013.01); *G08G 1/082* (2013.01); *G08G 1/083* (2013.01); *G08G 1/095* (2013.01)

(58) Field of Classification Search
CPC ..... G08G 1/096; G08G 1/0145; G08G 1/083; G08G 1/095
See application file for complete search history.

(56) References Cited

U.S. PATENT DOCUMENTS

| | | | | |
|---|---|---|---|---|
| 3,414,877 | A | 12/1968 | Cress, Jr. et al. | |
| 4,370,718 | A * | 1/1983 | Chasek | G08G 1/08 340/911 |
| 5,519,390 | A * | 5/1996 | Casini | G08G 1/096 340/925 |
| 6,087,962 | A * | 7/2000 | Rojas | G08G 1/096 340/925 |
| 6,268,805 | B1 * | 7/2001 | Simon | G08G 1/095 340/944 |
| 6,331,824 | B1 * | 12/2001 | Firestone | G08G 1/096 340/925 |
| 6,833,796 | B2 * | 12/2004 | Bourgault | G08G 1/096 340/925 |
| 8,212,688 | B2 | 7/2012 | Morioka et al. | |

(Continued)

*Primary Examiner* — Nay Tun

(57) ABSTRACT

Traffic signals that adapt to traffic conditions are provided with countdown timers. These countdown timers count down from some number towards zero, and indicate the approximate duration remaining before a traffic signal changes state. Since the traffic signal is continuously adapting to traffic conditions, the exact time before a state change occurs is not known in advance. Using a countdown algorithm, the countdown timers imperceptibly modify the countdown sequence in real time so that the traffic signal state change coincides approximately with the moment the countdown reaches its minimum count.

9 Claims, 2 Drawing Sheets

(56) References Cited

U.S. PATENT DOCUMENTS

| | | | | |
|---|---|---|---|---|
| 8,825,350 | B1 * | 9/2014 | Robinson | G08G 1/042 701/117 |
| 8,947,265 | B2 * | 2/2015 | Bernard | G08B 5/38 340/944 |
| 9,472,097 | B2 | 10/2016 | Stelzig et al. | |
| 9,595,193 | B1 | 3/2017 | Duale et al. | |
| 9,613,530 | B1 | 4/2017 | Duale et al. | |
| 9,818,297 | B2 | 11/2017 | El-Tantawy et al. | |
| 10,078,965 | B2 | 9/2018 | Duale et al. | |
| 10,127,811 | B2 | 11/2018 | Xu et al. | |
| 11,151,871 | B2 * | 10/2021 | Mimura | G08G 1/091 |
| 2002/0005790 | A1 * | 1/2002 | Georgalis | G08G 1/096 340/929 |
| 2004/0075583 | A1 * | 4/2004 | Chaffe | G08G 1/095 340/944 |
| 2010/0259419 | A1 * | 10/2010 | Renner | G08G 1/096 340/929 |
| 2016/0027299 | A1 * | 1/2016 | Raamot | G08G 1/0116 340/917 |
| 2016/0042641 | A1 * | 2/2016 | Smith | G08G 1/0133 340/917 |
| 2019/0251838 | A1 * | 8/2019 | Bernhardt | G08G 1/096822 |
| 2019/0355248 | A1 * | 11/2019 | Grant | G08G 1/005 |

* cited by examiner

[Fig. 1]
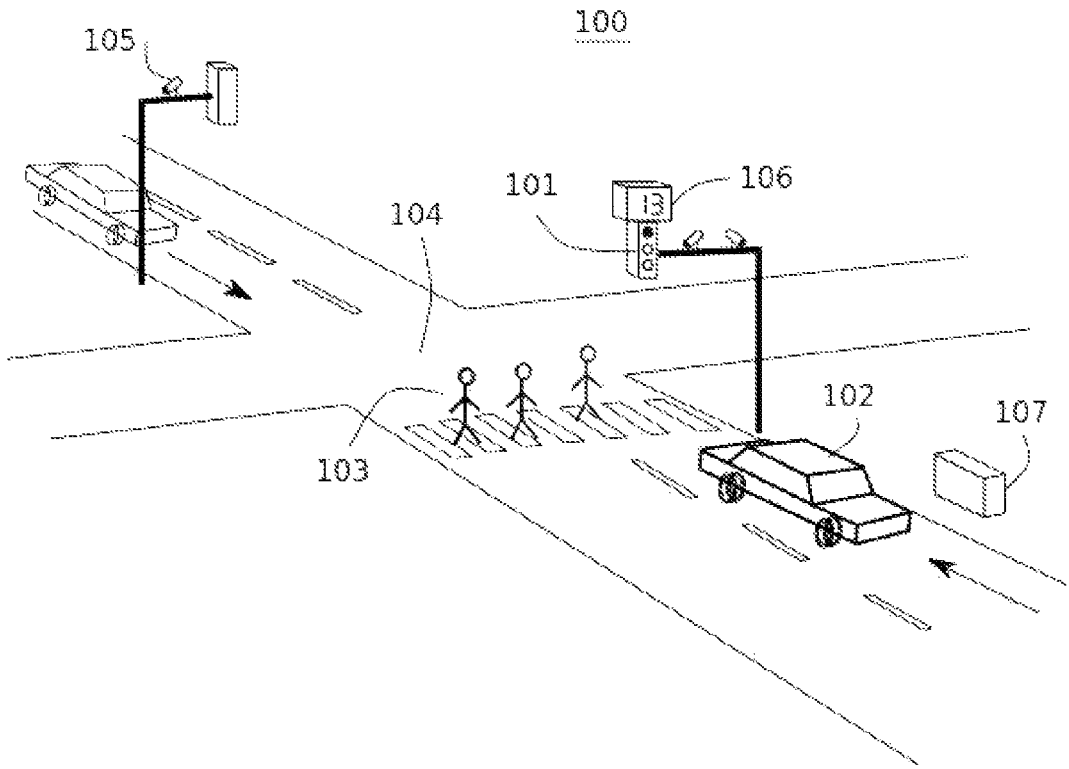
[Fig. 2]
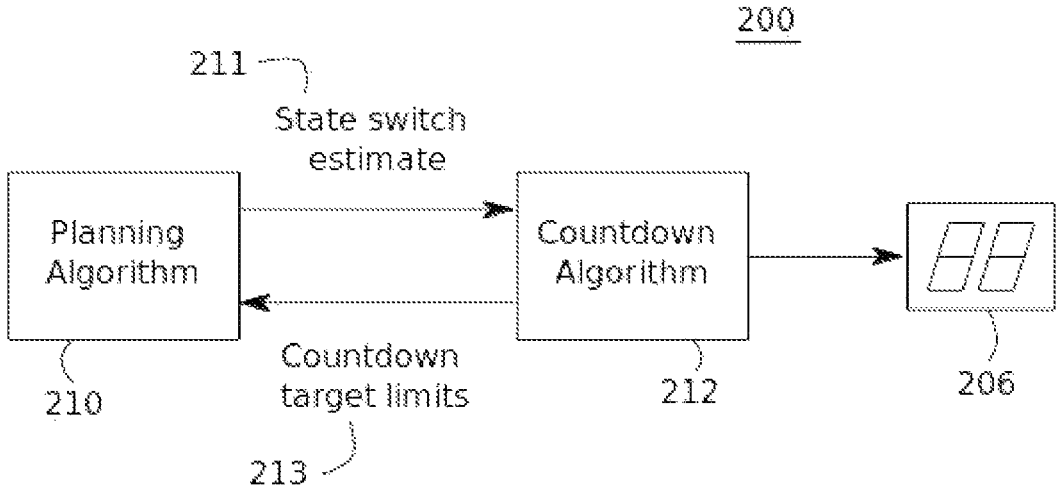

[Fig. 3]
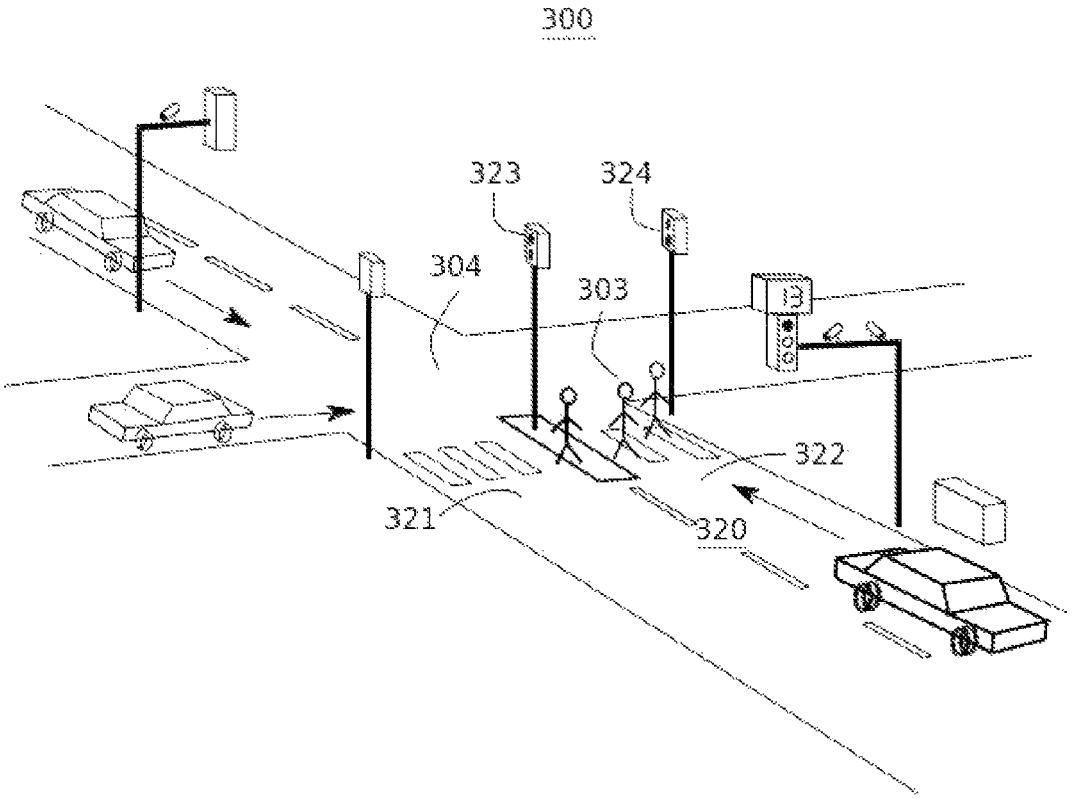

ADAPTIVE TRAFFIC SIGNAL WITH ADAPTIVE COUNTDOWN TIMERS

This patent claims priority from provisional patent application 201821033148 titled "ADAPTIVE TRAFFIC SIGNAL WITH LIVE FEEDBACK" filed in Mumbai, India on 4 Sep. 2018.

TECHNICAL FIELD

This patent relates to adaptive traffic signals. More specifically, the patent relates to an adaptive traffic signal with adaptive countdown timers.

BACKGROUND ART

Traffic signals ran on fixed timings when they were first invented. Recently traffic signals that adapt to traffic patterns have been created. This includes systems such as those described in U.S. Pat. Nos. 10,127,811, 10,078,965, 9,613,530, 9,595,193, 9,818,297, 9,472,097, and 8,212,688. These systems change traffic signaling timings based on traffic data.

Count down timers that count down to the time at which a signal will change from GO to STOP or STOP to GO are used in many locations in the world. These timers create driver comfort by signifying in advance when the next change may occur. They also improve driver readiness, thus reducing the total time spent at the traffic signal. To implement countdown timers, it is necessary to know in advance when the next signaling change will occur.

SUMMARY OF INVENTION

Traffic signals that adapt to traffic conditions are provided with countdown timers. These countdown timers count down from some number towards zero, and indicate the approximate duration remaining before a traffic signal changes state. Since the traffic signal is continuously adapting to traffic conditions, the exact time before a state change occurs is not known in advance. Using a countdown algorithm, the countdown timers imperceptibly modify the countdown sequence in real time so that the traffic signal state change coincides approximately with the moment the countdown reaches its minimum count.

The above and other preferred features, including various details of implementation and combination of elements are more particularly described with reference to the accompanying drawings and pointed out in the claims. It will be understood that the particular methods and systems described herein are shown by way of illustration only and not as limitations. As will be understood by those skilled in the art, the principles and features described herein may be employed in various and numerous embodiments without departing from the scope of the invention.

BRIEF DESCRIPTION OF DRAWINGS

The accompanying drawings, which are included as part of the present specification, illustrate the presently preferred embodiment and together with the general description given above and the detailed description of the preferred embodiment given below serve to explain and teach the principles of the present invention.

FIG. 1 depicts a system of adaptive traffic signaling according to an embodiment.

FIG. 2 depicts a system by which a countdown timer is displayed to vehicles while adaptively signaling traffic at a traffic intersection.

FIG. 3 depicts a system of traffic signaling according to an embodiment.

DESCRIPTION OF EMBODIMENTS

Traffic signals that adapt to traffic conditions are provided with countdown timers. These countdown timers count down from some number towards zero, and indicate the approximate duration remaining before a traffic signal changes state. Since the traffic signal is continuously adapting to traffic conditions, the exact time before a state change occurs is not known in advance. Using a countdown algorithm, the countdown timers imperceptibly modify the countdown sequence in real time so that the traffic signal state change coincides approximately with the moment the countdown reaches its minimum count.

FIG. 1 depicts a system 100 of adaptive traffic signaling according to an embodiment.

In an embodiment, lights 101 that signal traffic 102 and pedestrians 103 are present at an intersection 104. Also present at the intersection are one or more modalities of detecting the presence of vehicles and pedestrians. For example, multiple video cameras 105, wire sensing loops, LIDAR, SONAR, RADAR, buttons to be pressed by pedestrians, etc. may be provided. All the data is acquired by one or more data acquisition instruments. This data is used to control the traffic signal lights 101 optimally. In an embodiment, countdown timers 106 are displayed to vehicles and/or pedestrians of one, many or all lanes of traffic. The algorithm to control the traffic signals is present on a computation mechanism 107 present at the intersection 104 itself. The computation mechanism 107 is present close to the intersection 104.

In an embodiment, the traffic control algorithm continuously monitors the presence of vehicles and pedestrians using the modalities of detecting the presence of vehicles and pedestrians. It controls the traffic signals optimally. The traffic control algorithm signals traffic and pedestrians in a pattern that is not a fixed cycle but adapts to the detected presence of vehicles and pedestrians in real time (in an embodiment, "adapting in real time" means adapting at least once every two seconds). If a lane is currently signaled GO, and there is no further demand on that lane (no more waiting or incoming traffic), then the lane is signaled STOP, thus saving time of the traffic intersection. The traffic control algorithm also predicts in advance when there will be no further demand, so that the CAUTION signal may be turned on in advance of the STOP signal, further saving time. (In most standard traffic situations, GO is green, STOP is red, and CAUTION is yellow or amber.) In an embodiment, a high rate of data acquisition is used for the GO lane and a lower rate of data acquisition is used for the STOP lane. Data acquisition for the STOP lane is used to detect demand. This can be used to choose the next lane to signal GO. Alternatively, the sequence of lanes (phases) to be chosen is fixed and cannot be dynamically changed. It is also possible that the sequence is fixed, except that some of the phases are optional (such as side lanes with very low demand), and they may be avoided if no demand is detected. Even if choosing a certain side lane is avoided, in an embodiment, that lane will still be chosen at least once in a fixed while, to account for possible mistakes in acquiring or interpreting traffic data.

In an embodiment, the traffic control algorithm chooses stages among a pre-programmed set of stages (a stage is a combination of phases, where a phase is a set of signals that change their state at the same time. Phases for vehicles can be based on source streets or source-destination pairs.). The stages are preprogrammed to have no or a minimum number of conflicts. In another embodiment, the algorithm is given information about what phases conflict with what phases, but develops the stages on the fly.

In an embodiment, the traffic control algorithm chooses the stages and then timing in such a way as to minimize a certain metric. (Alternatively, the traffic control algorithm may choose the timing in a simple way—as long as there is demand for that stage, the signal stays on GO, and then moves to STOP. There may also be upper and lower bounds on how long a certain signal is allowed to stay on GO.) The metric may be the sum of time of all vehicles spent at that intersection. Another metric might be the sum of a non-linear function of the time of each vehicle spent at the intersection. The non-linear function may be chosen in such a way that a single vehicle is not permanently starved. For this purpose, the non-linear function may be chosen to be a convex function such as a quadratic function. The time or the non-linear function of time may be weighted by a number chosen separately for each vehicle before being added into the summed metric. The weights may be chosen in various ways. For example, the weight may be chosen to favor public transport. The weight may be chosen to reflect (proportionally or otherwise) the actual or presumed number of occupants of each vehicle. The weight may be chosen to be proportional to the area occupied by each vehicle. (In this final case, the detector may just detect the total area occupied by traffic rather than detecting individual vehicles separately.) Emergency vehicles may be detected (automatically, or through special signaling) and be provided large weights so that they can pass through the intersection quickly.

From this metric, vehicles which have already crossed the intersection may be removed. Vehicles which are present at the intersection are part of the metric being optimized. But vehicles that are yet to enter the intersection (not yet detected) may also be part of the metric. These future presumed vehicles may be vehicles whose information has been collected in various ways (possibly reported by the signaling system of a nearby intersection, other road sensors, data about people using GPS navigation or explicitly providing their information to the road infrastructure, predictions from a central server, etc.). Information about future vehicles may be present at an individual vehicle level or some statistical format (such as expected density and mix of traffic). In an embodiment, a heuristic algorithm takes decisions based on these inputs. In another embodiment, a planning algorithm plans strategies up to some time horizon in the future (2 minutes to an hour), and takes the next step based on such a future estimation. In yet another embodiment, the metric is weighted to give lesser importance to the future than the present—for example an exponential that diminishes into the future may be used. In still another embodiment, a planning algorithm plans strategies up to some time horizon in the future and the state at the moment of the time horizon is also given a heuristic metric (which may assume for example a simplified, possibly steady-state, traffic model from that moment onwards).

In an embodiment, the signal behavior degrades gracefully if it loses input from one or more detectors. For example, if it loses the detection of actual traffic of a particular lane, it may still be able to infer the density of traffic from viewing the traffic when that lane is in the GO state using other detectors, and it may also be able to detect that that lane does not have any more traffic demand and thus signal STOP, based on other detectors. If it loses information about a lane completely, it may switch to fixed timing based on past experience for only that lane, but may continue to signal the other lanes adaptively/dynamically. If it loses all information, or cannot make any decisions based on the information it still receives, or the situation is beyond the traffic control algorithm's ability to control, the algorithm falls back to a fixed timing cycle.

The system 100 may also be programmed in such a way that in certain times, fixed cycle timing, or simpler adaptive algorithms are used, and the full adaptive algorithm is used at other times. The algorithm may also detect that the traffic density from all directions is low, and automatically switch to a YIELD system from an explicit signaling system. (A YIELD system is usually a flashing red or amber light in all directions, possibly red in some and amber in other directions. This signals to all traffic that they may use the intersection while applying caution that other conflicting users of the intersection may be present.) In this way, for low traffic density, human negotiation achieves optimal timing not possible while signaling. In such a mode, the algorithm may predict by viewing far away traffic that contention could occur, and switches to explicit signaling before the contention does occur. It may choose to do this only momentarily and go back to YIELD, or may choose to continue signaling. The algorithm may switch from the YIELD mode directly to a signaling combination (stage) having some GOs and other STOPs, rather than going into all-STOP first. In such a scenario, the GOs may continue to be signaled by the YIELD system, while the STOPs are actually signaled with a STOP. When the next stage is chosen, the full correct signaling protocol is used.

Detection of vehicular and pedestrian traffic may be done by video cameras 105. Video cameras 105 are placed so that they record the intersection, each incoming and outgoing segment, pedestrian accumulation points, and also upstream segments for prediction. Machine learning algorithms are used to detect vehicles and pedestrians, and also to detect their intent. For example, does the vehicle intend to turn, go straight; is the pedestrian really interested in crossing, or is just waiting at the corner, etc. Models of driving and walking of each vehicle and pedestrian may also be created, to be used to predict behavior under various possible signaling patterns (phases/stages). This will help the planning algorithm. The models may be created based only on the type of vehicle detected, or based on the actual observed behavior.

The system 100 at intersection 104 also communicates with similar systems at nearby intersections. Systems at nearby intersections provide information about traffic that they have actually sent out towards this intersection, or also about their own future plans. These plans can be incorporated in the planning of this intersection. Vice versa, the system 100 at this intersection provides similar information to nearby intersections. This communication may be achieved through a central server or directly. Direct communication may be achieved over a common network backbone, or through a point-to-point link such as ethernet, fiber, microwave, WiFi, ad-hoc network or other link. The video cameras 105 of this intersection may be able to directly view the signals of nearby intersections, and use that for predicting incoming traffic flow.

The system 100 may also communicate detected traffic, images, and predicted plans to a central server. The central server may provide further global input to the system 100, such as near-term future density predictions based on information collated from all traffic signals, information about social events, construction, weather patterns, GPS data, mobile phone user data, etc. The system 100 communicates faults such as failed detectors, failed lights, traffic jams (deadlock/gridlock) to the central server. The central server may also update the algorithms in the system 100, e.g. optimize the various weights in the A.I. and planning algorithms to achieve more optimality.

FIG. 2 depicts a system 200 by which countdown timer 206 is displayed to vehicles while adaptively signaling traffic at a traffic intersection.

In an embodiment, countdown timer 206 is displayed to vehicles and/or pedestrians of one, many or all lanes of traffic. This timer 206 (and others also present at the intersection) counts down the time for which the corresponding signal will stay in the current state (STOP or GO); in other words, when the count reaches down to zero, the state of the traffic signal will switch from STOP to GO or GO to STOP. The countdown timer 206 may match the color of the current state for further benefit. Only one state may be counted down (only STOP or only GO). Since cycle times are not fixed in advance (not fixed even adaptively), the exact time to count down is not known. The planning algorithm 210 (the timing planning part of the traffic control algorithm) that is switching the signals also creates an estimate 211 of the moment when the state of a signal will change next. The estimate 211 may be a single time period estimate, or a structure giving probabilities of possible state switch moments.

Just as the state of the signal changes, this estimate 211 is used by the countdown algorithm 212 to begin the countdown to the next state change. As time progresses, the planning algorithm 210 updates the estimate 211. The countdown algorithm 212 behaves in such a way that the countdown timer 206 is quite close to zero (or whatever is the appropriate terminal count expected by drivers, pedestrians and autonomous vehicles) at the actual moment of state change. But, it does not necessarily display the best time estimate available at the moment. (If it did that, there would be perceptual problems for users as the estimate may vary perceptibly and may even increase as time passes, instead of decreasing which would be the behavior expected of a counter). The countdown algorithm 212 behaves in a way that countdown timer 206 is perceived to be a simple fixed interval down count, and still the countdown timer 206 optimally targets the moment of state switch. This is achieved by subtly changing the time period of counting down of count displayed on countdown timer 206. In other words, the speed or rate of the displayed count is subtly altered in a manner that is imperceptible or hard to perceive. For example, if the countdown is currently at a number and moving at a rate that will cause it to reach zero before the current estimated mode switch time, then the time period of the countdown is subtly increased. The time period may not be increased enough to directly target the exact time period, but subtle increases in time period may be used more than once. Similarly, if the countdown is currently at a number and moving at a rate that will cause it to reach zero after the current estimated mode switch time, then the time period is subtly hastened. The time period must not vary perceptibly from the original countdown period that the timer 206 began counting down with (which in an embodiment may be a one second countdown period as the countdown begins). In other words, the time period will not be changed beyond a certain bound more than or less than the original countdown period. In dire situations, a few counts (at most a fixed small number such as 1 or 2) may be skipped. Also, it may be acceptable to reach a small count such as 1, 2 or 3 rather than exact zero when the mode switches from STOP to GO. It may also be acceptable that the mode switch from GO to STOP happens 2 to 3 seconds after the countdown timer 206 reaches zero.

Feedback 213 from the countdown algorithm 212 to the planning algorithm 210 is a message conveying the range of time instants that can be targeted as the instant when the mode switch occurs by the current state of the countdown. In an embodiment, feedback 213 from the countdown algorithm 212 is used to finally actually switch the mode, so that the countdown timer 206 is not seen to be wrong. In an embodiment, the planning algorithm 210 collects feedback from all the currently running countdown timers as to what is the range of time instants when they can feasibly reach their respective mode changes: that the respective mode changes should occur within the corresponding ranges is then taken as a constraint by the planning algorithm 210 while optimizing flow of traffic.

In an embodiment, there is a mathematical metric that calculates a score for any particular displayed or imagined countdown sequence that gets displayed, the metric being an approximation of how steady or unsteady that specific countdown sequence will be perceived to be by an observer. The metric may be a combination of the following factors:

(a) differences between successive countdown time intervals (a count downtime interval being defined as the amount of time between a change-of-count event and the next change-of-count event)

(b) differences between the successive differences calculated in (a)

(c) differences between the successive differences calculated in (b) and so forth (d) deviation of countdown time intervals from the initial countdown time interval (e) the maximum deviation of any countdown time interval from any other countdown time interval (f) the exact count displayed when the state switch actually occurs, or how much extra time is taken for the state switch to occur after the minimum count (usually '0') is displayed (g) the number of skipped counts (h) the average countdown time interval Based on this metric, the countdown algorithm 212 performs the following steps:

(1) The countdown algorithm 212 accepts a probability structure of possible state change times from the planning algorithm 210 (or if the planning algorithm 210 just sends a single estimated state change time, the countdown algorithm 212 generates such a probability structure based on received statistics of the estimate and previous estimates).

(2) For each envisioned next countdown time interval, the planning algorithm 210 calculates the following:

(2.1) For each state change time in the possible state change times in the probability structure, the planning algorithm 210 calculates the following:

(2.1.1) The planning algorithm 210 calculates the metric of the countdown sequence whose first countdown time interval is the countdown time interval set in step (2) and subsequent countdown time intervals are chosen so as to minimize the metric assuming the state change occurs at the specific state change time set in step (2.1)

(2.2) The planning algorithm 210 calculates an expectation of the metric calculated in step (2.1.1) over all possible state change times, using the probabilities in the probability structure.

(3) The countdown algorithm 212 sets the next countdown time interval to be the one that gives the minimum expected metric as calculated in step (2.2).

In short the countdown algorithm 212 sets the next countdown time interval to be the one that minimizes expected value of the minimum metric calculated as a function of the random variable state change time. In an embodiment, the countdown algorithm 212 reports back to the planning algorithm not only the possible limits of time instants that the current countdown can still target, but the value of the metric (that approximates perceptual evenness) value for targeting each of the time instants within this range of time instants. The planning algorithm 210 may incorporate this metric in its own metric (primarily based on traffic performance) that the planning algorithm 210 minimizes.

The countdown algorithm 212 may be implemented as software or as hardware. The hardware running the countdown algorithm and the countdown timer 206 (display) may together form a single hardware unit, which may communicate with the planning algorithm 210 running on a computation mechanism present at the intersection. Alternatively, the countdown algorithm 212 and planning algorithm 210 may both run on the computation mechanism present at the intersection, and the communication with a separate hardware countdown timer 206 may involve setting or modifying the count displayed on the countdown timer 206 or setting or modifying the countdown time interval.

FIG. 3 depicts a system 300 of traffic signaling according to an embodiment.

In an embodiment, a two-way street 320 having segments 321 and 322 flowing in opposite directions has separate pedestrian signals 323 and 324 to regulate pedestrians on each of the two segments 321 and 322. Pedestrians 303 navigate the two segments at different times. In this way, there is no need for a separate pedestrian stage for this street, and total time of the intersection 304 is saved. When the outgoing segment 322 is stopped, the pedestrian signals 324 signal the pedestrians to cross the segment 322, and when the incoming segment 321 is unused (e.g. when the outgoing segment 322 has flowing vehicular traffic), the pedestrian signals 323 signal the pedestrians to cross the segment 321. When the pedestrian signals 323 signal the pedestrians to cross the segment 321, u-turn by vehicles going out from segment 322 may be prevented, or the vehicles may be warned to yield to pedestrians; and right turn (left turn in left drive countries) by the adjoining lane may also be prevented or the vehicles may be warned to yield to pedestrians.

An adaptive traffic signal with adaptive countdown timers is disclosed. It is understood that the embodiments described herein are for the purpose of elucidation and should not be considered limiting the subject matter of the present patent. Various modifications, uses, substitutions, recombinations, improvements, methods of productions without departing from the scope or spirit of the present invention would be evident to a person skilled in the art.

The invention claimed is:

1. A system of controlling vehicular and pedestrian traffic at an intersection comprising:

a plurality of lights configured to signal vehicles and pedestrians to stop and go in various directions, sensors for detecting the presence of vehicles and pedestrians, computation mechanism present close to the intersection, and one or more countdown timers, each countdown timer configured to display a count that counts downwards, wherein the computation mechanism is configured to use information gathered from the sensors for detecting the presence of vehicles and pedestrians to change the lights to signal vehicles and pedestrians in a signaling pattern that is not predetermined, each countdown timer is associated with a group of lights in such a way that when the count displayed by the countdown timer reaches a first count that is a number among zero, one, two or three, the state of the group of lights changes, and at least one countdown timer adjusts the speed of the countdown in a manner that is hard to perceive in such a way that the moment of change of state of the associated group of lights occurs when the count displayed by the countdown timer is among zero, one, two or three.

2. The system of claim 1 wherein the countdown timer that adjusts the speed of the countdown is part of a single hardware unit also configured to run a countdown algorithm, the countdown algorithm configured to adjust the speed of the countdown displayed by the countdown timer.

3. The method of claim 1, wherein the first count is zero.

4. The method of claim 1, wherein the first count is a count expected by at least one of drivers, pedestrians, and autonomous vehicles.

5. A method of controlling vehicular and pedestrian traffic at an intersection comprising:

detecting the presence of vehicles and pedestrians, using the information of the presence of vehicles and pedestrians to signal vehicles and pedestrians to stop and go in various directions, displaying one or more counts that are counting down to vehicles or pedestrians, and adjusting the speed of counting down in a manner that is hard to perceive in such a way that the moment of changing from stop to go or go to stop in a particular direction occurs while the displayed count is zero, one, two or three.

6. The method of claim 5, wherein the step of adjusting the speed of counting down in a manner that is hard to perceive comprises minimizing a metric.

7. The method of claim 6, wherein the metric is calculated based upon differences between successive countdown time intervals.

8. The method of claim 7, wherein the metric is calculated also based upon the differences between the successive differences between successive countdown time intervals.

9. The method of claim 6, further comprising minimizing the expected value of the minimum metric calculated as a function of the random variable state change time.

* * * * *